United States Patent [19]

Kotlyar

[11] Patent Number: 4,734,892

[45] Date of Patent: Mar. 29, 1988

[54] METHOD AND TOOL FOR LOGGING-WHILE-DRILLING

[76] Inventor: Oleg Kotlyar, 3714 S. Highland Dr., #19, Salt Lake City, Utah 84106

[21] Appl. No.: 796,586

[22] Filed: Nov. 8, 1985

Related U.S. Application Data

[63] Continuation-in-part of Ser. No. 529,381, Sep. 6, 1983, abandoned.

[51] Int. Cl.[4] ..... H04H 9/00; G01V 1/00

[52] U.S. Cl. ..... 367/83; 367/84; 340/861; 175/40

[58] Field of Search ..... 367/25, 81–85, 367/911; 181/102; 340/853, 861; 33/306, 307; 73/151; 175/40, 45, 48, 50, 232; 310/93, 77; 188/292, 290; 415/123, 502, 501

[56] References Cited

U.S. PATENT DOCUMENTS

| | | | |
|---|---|---|---|
| 1,683,665 | 9/1928 | Griffith | 188/292 |
| 2,018,968 | 10/1935 | Nordberg | 188/292 |
| 2,352,833 | 7/1944 | Hassler | 367/83 X |
| 3,174,064 | 3/1965 | Muller | 310/93 X |
| 3,309,656 | 3/1967 | Godbey | 367/85 |
| 3,655,303 | 4/1972 | Cotton | 418/61 A |
| 3,705,603 | 12/1972 | Hawk | 340/853 X |
| 3,737,843 | 6/1973 | Le Peuvedic et al. | 367/85 |
| 3,764,968 | 10/1973 | Anderson | 367/84 |
| 3,770,006 | 11/1973 | Sexton et al. | 367/83 X |
| 3,861,866 | 1/1975 | Saario | 415/123 X |
| 3,867,714 | 2/1975 | Patton | 367/85 |
| 3,964,556 | 6/1976 | Gearhart et al. | 367/83 X |
| 4,078,620 | 3/1978 | Westlake et al. | 175/48 |
| 4,184,545 | 1/1980 | Claycomb | 367/85 X |

*Primary Examiner*—Deborah L. Kyle
*Assistant Examiner*—Brian S. Steinberger
*Attorney, Agent, or Firm*—Beehler, Pavitt, Siegemund, Jagger, Martella & Dawes

[57] ABSTRACT

A logging-while-drilling tool includes a housing positioned in a drill string, a shaft journaled in the housing, a turbine stage or stages, a rotor or rotors, the latter mounted on the shaft outside of the housing and driven by the drilling fluid and a braking device for variably controlling the rotational speed of the rotor in order to produce pressure pulses which are transmitted to the surface through the drilling fluid. A generator or other energy storing device is provided to power an electronic package which interprets downhole conditions for transmission of the same as pressure pulses.

8 Claims, 8 Drawing Figures

METHOD AND TOOL FOR LOGGING-WHILE-DRILLING

RELATED APPLICATIONS

This application is a continuation-in-part of my earlier copending application Ser. No. 06/529,381, filed on Sept. 6, 1983, abandoned.

BACKGROUND OF THE INVENTION

The present invention provides a methodology means for data transmission through the drill string and relates generally to a logging-while-drilling tool and more particularly to an improved logging-while-drilling tool by which measurements of downhole conditions within a borehole are telemetered to the surface of the earth by means of a wave passing upward through the drilling fluid and which wave may be positive or negative pressure pulses or both.

BRIEF DESCRIPTION OF THE PRIOR ART

When drilling a well, it is very useful to know one or more of a number of downhole parameters concerning the downhole directional information and conditions of the borehole, and even the nature of the formation, while a drilling operation is in progress. Typically such information includes weight on the bit, RPM, natural gamma, formation resistivity, bottom hole temperature, bottom hole pressure and the like and virtually any information related to detectable conditions, as is well known in the art. The information may be detected in a variety of ways, well known in the art, and is usually converted to some form of electrical data signal. The initially derived information, now in the form of an electrical signal or value may then be electronically converted to a format for transmission to the surface, usually in digital format. Such information is usually transmitted from the bottom of the borehole to the surface as a series of hydraulic pulses produced in and transmitted through the drilling fluid, the pressure pulses representing the electrical information. The information, in the form of pulses, may be transmitted to the surface without disturbing the normal drilling operations or ceasing the flow of drilling fluid. At the surface, the pressure pulses are detected, usually converted back to electrical signals and processed to provide the sought for information in a useable format.

It is common to create pressure pulses in drilling fluid by periodically interrupting the normal flow of the fluid through the drill string, or diverting a portion of the flow into the annulus of the drill string, to form a series of pulses in the drilling fluid which is normally pressurized and which normally flows down through the drill string and back up annulus around the outer surface of the drill string.

Thus, for example, a variety of systems have been used to form the pressure pulses and to effect transmission to the surface. In most instances, the pulsing system involves some form of valve so positioned that the entire fluid flow through the drill string also flows through the valve. The recognized difficulty with this arrangement is that drilling fluid, due to its composition, the rate of flow and volume thereof, tends to be quite abrasive. In valves of the type mentioned and through which essentially the entire fluid flow passes, the valves are subject to failure due to rapid wear as a result of erosion by the fluid. Regardless of the design of the valve, there comes a point in the operation, just prior to shut-off in which the orifice becomes quite small and the fluid velocity is quite high resulting in erosion. In moving from the closed position to the open position, essentially the same is true in the early phase of the operation of valve opening.

Since data is transmitted by pulses involving opening and closing of the valve, each valve cycle needed to produce one pulse involves a dual exposure to extremely high velocity fluid flow. In light of the fact that the transmission of data may involve a significant number of pulses, the life of the valves is somewhat limited. One solution to this problem has been to bypass a portion of the flow as described for example in U.S. Pat. No. 4,078,620. Another and different solution is to use a static pressurized system, as described in U.S. Pat. No. 3,964,556.

A number of U.S. Patents show the use of rotary "turbine-like" valves which include a rotor and a stator. Both the rotor and stator have slots which can be aligned to open the valve and let drilling fluid pass through or misaligned to close the valve and provide a strong resistance to the passing of the drilling fluid. U.S. Pat. No. 3,770,006 of Sexton et al shows a turbine driving an electric power generator which in turn runs an electric motor for positioning a turbine valve. U.S. Pat. No. 3,705,603 of Hawk refers to "a motor actuated rotary valve" which turns between an open position and a closed position in a rotary fashion. Turbines are also used for generating the electrical power needed to operate the logging-while-drilling apparatus. This is shown in the patents referenced but is also used with non-rotary valves to create the pressure pulses as shown in U.S. Pat. No. 3,737,843 of Le Peuvedic et al. Numerous other patents show the use of turbines for generating power in a downhole logging-while-drilling apparatus and also show the use of rotary turbine-like valves which operate in an open and shut mode for generating the pressure pulses. Those systems shown in the patents referenced and others known to the inventor which use rotary valves for periodically interrupting a drilling fluid in order to generate pulses are motor actuated with the electrical power generated by a separate turbine motor.

Other prior patents such as U.S. Pat. No. 2,352,833 describe a choke valve in the form of a rotatable and fixed set of vanes which are operated by latching means to effect pulsing. One set of vanes is rotatable by the turbine action of the fluid and the latching means functions to hold the rotatable vanes in a closed position relative to the fixed vanes. It is also known to use a three position valve to create positive and negative pulses.

It is thus desirable to provide a versatile system for the transmission of data from a borehole to the surface in the form of pressure pulses in which the problems heretofore associated with erosive wear of the valve assemblies is significantly reduced.

It is also an object of the present invention to provide a pulsing system for the purposes of transmitting data from a borehole to the surface in which the flow of drilling fluid through the drill string is maintained during the data transmission phase, i.e., flow of drilling fluid is not stopped in order to generate a pressure pulse.

Another object of the present invention is the provision of an improved pulse generating system for transmitting data from a borehole to the surface in the form of pressure pulses in which the pulses are positive or negative or both and in which flow of drilling fluid through the drill string is not interrupted. The continuous flow reduces the erosion of the pulse generating system. Since a portion of the flow is not bypassed into the annulus around the outside of the drill string, the hydraulic power losses are reduced.

A further object of this invention is the provision of an improved telemetering system for pressure transmission of data from a borehole to the surface in which essentially all of the fluid flowing through the drill string continues to flow through the string and through the drill bit during data transmission and in which none of the fluid flow is bypassed from the drill bit or stopped during the data transmission phase.

BRIEF DESCRIPTION OF THE INVENTION

The above and other objects are achieved in accordance with the present invention by the provision of a method for logging-while-drilling which includes variable rotation device, preferably in the form of a turbine rotor or rotors of a turbine stage or stages with a changing pressure drop across the stage depending on rotor rotational speed (RPM). This variable rotation of a turbine rotor is carried out by the flow of drilling fluid through the inside of the drill string. The variability of the turbine rotor RPM is caused by changing of torsional loading torque on the rotor shaft. Such variable rotation of the turbine rotor generates the variable pressure drop across the turbine stage(s) to form the pressure wave signal in the drilling fluid. Thus, the turbine is a self rotating mud-pulse transmitter (or a pulsing turbine) working in a controllable pulsing regime of rotor rotational speed. Self-rotation provides very low energy consumption in the apparatus, one of the principal advantages of the apparatus of this invention.

Rotational devices are known which have different pressure response characteristics with respect to rotor rotational speed. A typical example is a turbine composed of a stator and rotor, of which several types exist. For example, in one type of turbine structure, a change in the rotational speed of the rotor does not cause any significant pressure change. There are other types of turbines, however, in which changing the rotational speed of the rotor may cause an increase in pressure or a decrease in pressure response characteristic depending upon the construction of the turbine, all of which is well known in the art. In accordance with this invention, either type of turbine which has a significant pressure response characteristic in the sense that variations in a predetermined pressure profile as a result of changing rotor RPM creates a significant pressure change may be used in the practice of this invention.

Thus, for example, as the rotor speed of the turbine is reduced, one type of turbine structure undergoes an increase in pressure from an initially comparatively low pressure. In the case of the other type of turbine structure, a decrease in the rotor speed causes a decrease in pressure from an initially comparatively high pressure. In this way, a turbine may be selected to provide either a positive or negative pressure pulse in response to reduction in rotor speed. These types of turbine structures, in accordance with the present invention, may also be used to generate both negative and positive pulses in response to changes in rotor speed by operating the turbines in a mode in which at one speed in which the pressure is assigned a null value and then increasing the rotor speed to create a positive or negative pulse or by decreasing the rotor speed to provide a negative or positive pulse, respectively. In either case, it is the control of the rotor speed which effects the pulsing by bringing about a change in pressure.

While turbodrilling with a turbine which has a pressure response characteristic with respect to the turbine rotor rotational speed, it is also possible to use the turbine of the turbodrill as a pressure transmitter (to send pressure pulses to the surface) by means of variable braking of the turbine shaft.

A logging-while-drilling tool according to the present invention thus includes a sealed housing to be positioned in a drill string, a shaft journaled in the sealed housing, a means located inside or ouside of the housing for variably slowing the rotational speed of the shaft and a turbine rotor mounted on the shaft outside of the housing, normally either just above it or just below it. The drilling fluid is circulated through the drill string and flows around the housing. The turbine rotor is driven by the drilling fluid going down through the drill string. A typical means for variably slowing the rotational speed of the turbine rotor would be a brake within the housing for variably slowing the rotation speed of the shaft. In such an arrangement, a generator may be driven by the shaft to generate the electric power for operating the brake. Alternatively, some means for storing electric energy such as a battery can operate the brake.

In another arrangement, a pump within the housing is driven by the shaft. The pump has a fluid, oil for example, contained within the housing and preferably other than drilling fluid circulating between the discharge output and the suction input and a control solenoid valve to variably restrict the passage of the fluid on the discharge side. The shaft is variably slowed by variably restricting the passage of the fluid through the control valve. In this case pump and solenoid control valve work like a hydraulic brake but with fluid which is considerable less abrasive than drilling fluid. In one arrangement, a generator driven by the shaft generates electric power for operating the control valve.

In any arrangement, a turbine stator is operably positioned within the drill string for acting with the turbine rotor to form a turbine stage.

It can thus be seen that drilling fluid continues to flow through the drill string during the data transmission operation, even though drilling may cease momentarily, as during a survey. The continued flow of drilling fluid through the drill string and through the drill bit tends to prevent the bit from sticking in the hole. It is, however, to transmit data while drilling, if that is desired.

These and other objects, advantages and features of this invention will be apparent from the following description taken with reference to the accompanying drawing, wherein is shown the preferred embodiments of the invention.

DETAILED DESCRIPTION OF THE INVENTION

Figure 1:
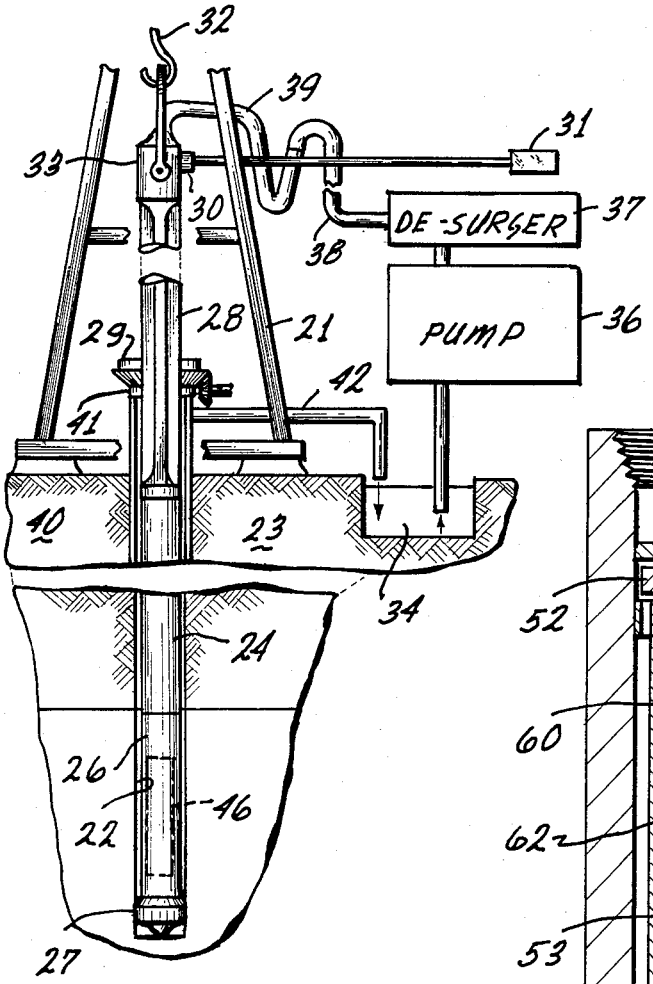
FIG. 1 is a schematic elevation of a rotary drilling apparatus including in vertical section a well containing a drill string in which the present invention is employed.

Referring now to the drawings which illustrate preferred forms of the present invention, and in particular to FIG. 1, a derrick 21 is disposed over the well 22 being formed in the earth 23 by rotary drilling, for example. It is understood that a downhole motor may be used, if desired. The drill string 24 is suspended within the well and has a drill bit 27 at its lower end and a kelly 28 at its upper end. A rotary table 29 cooperates with kelly 28 to rotate string 24 and bit 27. A pressure transducer 30 and an electronics pulse detecting system 31 are used to detect and the pressure pulses and convert them to electrical signals. The transducer and electronics are well known. A swivel 33 is attached to the upper end of kelly 28 which in turn is supported by hook 32 from a traveling block (not shown). This arrangement not only supports drill string 24 in an operable position within well 22 but also forms a rotary connection between the source of circulating drilling fluid, such as mud, and drill string 24. It should be understood that "mud" as used throughout this disclosure is intended to cover those fluids normally used in rotary drilling operations and to power a downhole motor.

A pump 36 transfers drilling mud from a source such as pit 34, through desurger 37 into line 38. The desurger 37 is adapted to reduce the pulsating effect of pump 36 as is well known in the art. The mud flows through mud line 38, flexible hose 39, swivel 33, drill string 24, and exits through openings (not shown) in drill bit 27 to pass outward into well annulus 22. The mud then circulates upwardly carrying drill cuttings with it through the annulus between the well and drill string 24 to the surface of the earth 23. At the surface, wellhead 41 is secured to casing 40 which is cemented in well 22. Pipe 42 is connected to casing 40 for returning the mud to pit 34.

Figure 2:
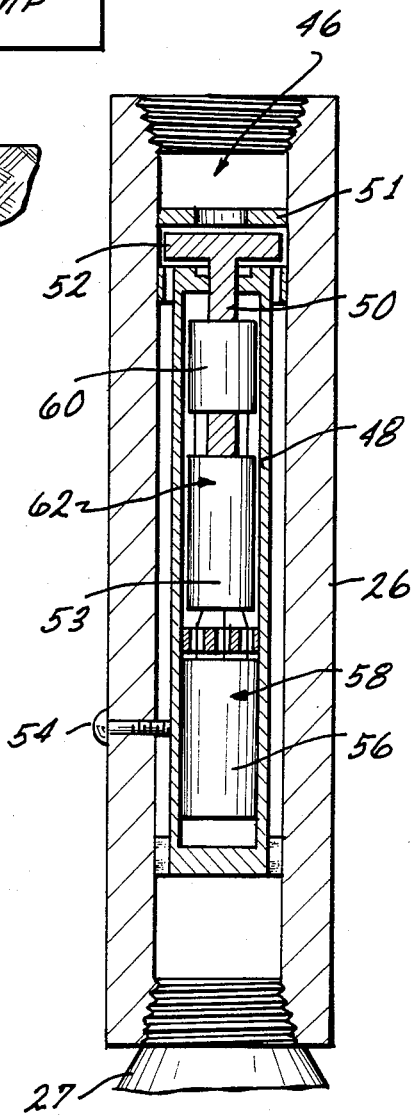
FIG. 2 is a schematic elevation, partly in section, of a portion of the drill string of FIG. 1, having the present logging-while-drilling tool mounted therein.

As schematically illustrated in FIGS. 1 and 2, a logging-while-drilling tool 46 is located in drill collar 26 which forms a part of the lower end of drill string 24 near bit 27.

Referring now to FIG. 2, logging-while-drilling tool 46 includes a housing 48 positioned within drill collar 26, a shaft 50 journaled in the housing, a turbine rotor 52 mounted on the shaft outside of the housing and means such as brake 53 for variably slowing the rotation speed of the turbine rotor. The housing 48 is sealed from the drilling fluid which flows through the turbine and around the housing to the drill bit 27. Drilling fluid circulated through the drill string will flow around housing 48, driving turbine rotor 52. A turbine stator 51 is operably positioned within the drill string for acting with the turbine rotor to form a turbine stage.

Sensors of the electronic package 56 are capable of measuring a desired downhole conditions including inclination azimuth, tool facing, resistivity of drilling formations, etc. and converting the measurements to an electrical signals. For example, sensor 54, in the case illustrated is a strain gauge, and is normally positioned downhole on or near tool 46, in the case illustrated on the drill collar 26 to measure the downhole weight on bit 27.

The signal from sensor 54 is applied to electronic package 56 which is sealed in compartment 58 of tool housing 48. For examples of package 56, see U.S. Pat. No. 3,309,656. Circuitry in package 56, in response to the signal from sensor 54 allows a defined amount of power from an electric power generator 60 located in housing 48 to flow to brake 53 in compartment 62 for variably slowing the rotation speed of the shaft 50 which is connected to the rotor 52. Generator 60 is driven by shaft 50 and generates electric power for operating the brake. It is thus easily seen that since turbine rotor 52 is directly in the path of much of the mud flow, momentarily substantially increasing its resistance to rotation and reducing rotor RPM creates a substantial pressure pulse in the flowing mud which pressure pulse may be positive or negative depending upon the type of turbine used, and which pressure pulse is transmitted through the mud to the surface where it is detected by equipment well known for conversion into useable data.

When it is desired to gather and to transmit downhole information, a pressure pulse may be transmitted downhole, as described in U.S. Pat. No. 4,078,620, for example, it being understood that the downhole package 56 is provided with the appropriate instrumentation as described in this patent which also describes the surface detection equipment. Depending upon the nature of the information sought, rotation of the string may be stopped or rotation of the bit may be stopped, but the flow of mud through the turbine stage continues. Rotation of the string is normally stopped during a survey to ascertain position data. Once the survey is complete, drilling may be resumed and the data transmission phase is initiated. In this phase, the mud continues to flow and the turbine system is used to generate pressure pulses which are transmitted up the mud column to the surface. As long as the mud flows through the string, as is the normal case in the operation of the present invention, mud also flows through the drill bit 27. In other words, the flow of mud is continuous through the drill string and the drill bit and need not be stopped, nor does the transmission of data result in interruption of mud flow in the sense that flow is periodically shut off to create a pressure pulse.

As long as mud is flowing the rotor 52 rotates at some given RPM which represents a no data transmission or null mode. When data is to be transmitted, the pressure pulsing may be positive or negative or both with respect to the pressure condition in the no data transmission null mode. For example, if the turbine stage is of the type in which a decrease in RPM brings about a pressure increase, then the pulse is positive with respect to the null mode as the RPM of the rotor decreases. If the RPM is increased above that which represents the null mode, then the pressure pulse is negative with respect to the null mode. Alternately, if the turbine stage is of a type in which reduction in the RPM of the rotor brings about a pressure decrease, the decreasing the RPM from the null mode creates a negative pulse with respect to the null mode. In this case, increasing the RPM of the rotor creates a positive pulse with respect to the null mode.

As is apparent, the null mode may in fact represent a free running condition of the rotor in which case decreasing the RPM of the rotor may result in either a negative or positive pulse depending upon the nature of the turbine. Regardless of the mode, pulsing is effected without interruption of mud flow or diverting any portion of the mud through a side wall of the string before it exits out of the drill bit.

To effect pulsing, the brake 53 is pulsed under the control of the electronic package 56 to effect momentary reduction in the RPM of the rotor 52 and the creation of pressure pulses in the mud. If the rotor is in a free running mode, either positive or negative pressure pulses are created depending upon the type of turbine used. For both positive and negative pulsing, the brake is applied to establish a null mode and then pulsed to reduce RPM or permit RPM to increase depending upon whether one or the other type of pulse is to be generated. There are advantages in being able to transmit data in one pulse mode, e.g., positive and switching to another pulse mode, e.g. negative or periodically using a different pulse for specific coded data transmission. A trinary code may be used for example in order to transmit a significantly larger amount of information in comparison with information transmitted by a binary code.

Figure 3:
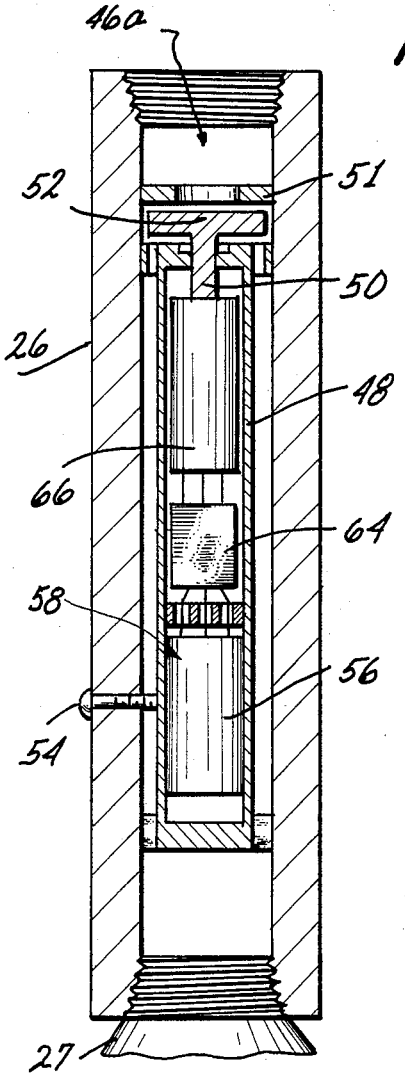
FIG. 3 is a schematic elevation, partly in section, of a portion of the drill string of FIG. 1, having an alternative embodiment of the present logging-while-drilling tool mounted therein.

Referring now to FIG. 3, where like elements are given like numbers to that of FIG. 2, an alternative embodiment 46*a* of a logging-while-drilling tool according to the present invention is shown. The logging-while-drilling tool 46*a* includes means such as battery 64 for storing electric energy for operating a brake 66 responsively to electronic package 56. The remaining operation of the system is as already described.

Figure 4:
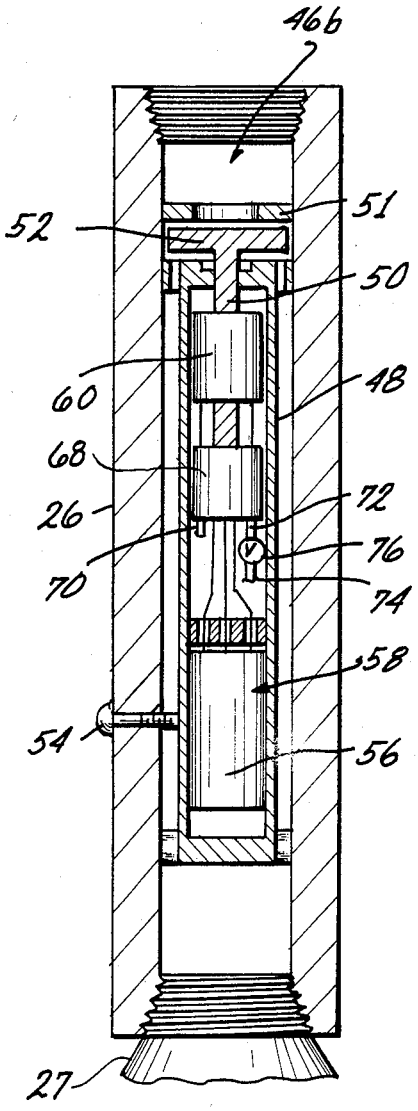
FIG. 4 is a schematic elevation, partly in section, of a portion of the drill string of FIG. 1, having yet another embodiment of a logging-while-drilling tool according to the present invention mounted therein.

Referring now to FIG. 4, where like elements are given like numbers as in FIG. 2, yet another alternative embodiment of a logging-while-drilling tool according to the present invention is referred to generally by reference 46*b*. The logging-while-drilling tool 46*b* includes a pump 68 within housing 48 and preferably directly driven by shaft 50 of the rotor 52. The housing 48 is a sealed housing, as described, and contains a fluid such as hydraulic fluid which is circulated within the housing. To effect such circulation, the pump includes a suction input 70 and discharge output 72 which includes a discharge end 74. A control solenoid valve 76 variably restricts the passage of the fluid on the discharge side 72 in response to control signals from the electronic package 56.

In operation, as mud flows through the string, the rotor of the turbine is rotated and shaft 50 also rotates to drive the pump 68. If the valve 76 is fully open, then the pump 68 merely circulates fluid in the housing from the input 70 through the output 74 and into the chamber. If, however, the valve 76 is closed completely, then there is no discharge of fluid and the pump loads and tends to slow down in RPM ultimately to zero. This also slows the RPM of the shaft 50 and the rotor RPM to zero since the rotor is connected to the shaft. The reduction of the rotor RPM creates a pressure pulse, as already described. In the event that it is desired to use a dual pulsing mode, valve 76 is partially closed to reduce the speed of the rotor to the null condition previously described. From the null condition, the valve 76 may be periodically fully opened or fully closed or operated in a sequence to generate pressure pulses of the desired type, depending upon the nature of the turbine. The valve operation is controlled by the electronic package 56.

The advantage of the system of FIG. 4 is that the control valve 76 is not exposed to the abrasive effects of the mud, since this valve operates in a sealed hydraulic system. Further, since the system operates as a hydraulic brake, there is no frictional contact with a rotating shaft to cause brake wear. In all other respects the system is similar to those already described.

Figure 5:
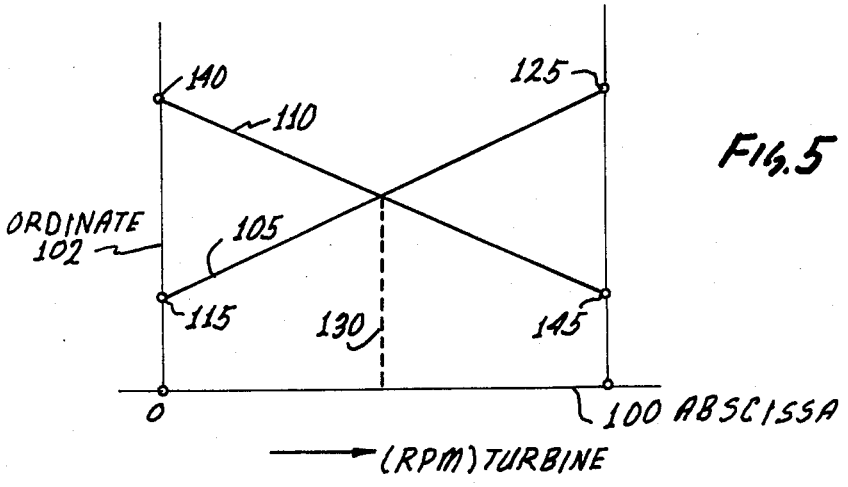
FIG. 5 is a graph illustrating the relationship between changes in pressure with respect to changes in RPM of various turbine stage.

The present invention may also be understood with respect to FIG. 5 in which RPM of the turbine stage is plotted as the abscissa 100 while the pressure drop (delta P) across the turbine stage is plotted as the ordinate 102 for turbine stage types 105 and 110. For turbine stage 105, an increase in RPM brings about an increase in the pressure drop from point 115 to a higher pressure drop 125, points 115 and 125 representing zero RPM and an idling RPM, for example. Point 130 represents a null point, for example.

In the case of turbine stage 110, an increase in RPM from zero at point 140 to an idle RPM at point 145 results in a decrease in the pressure drop (delta P), again with a null point at 130.

Figure 6A:
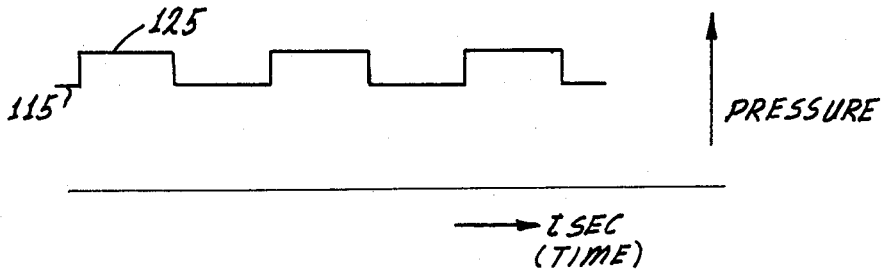
FIG. 6*a* is a graphical illustration of a positive pulsing mode of one of the turbine stages of FIG. 5.

Referring now to FIG. 6*a*, the abscissa represents time, in seconds or fractions thereof, and the ordinate represents the change in pressure for turbine stage 105. Accordingly, as the RPM of the turbine stage increases from zero RPM at 115 to an idle RPM at 125, a positive pulse results, as illustrated. Pulsing is thus achieved by periodically increasing or permitting the RPM to increase with a corresponding increase in the pressure drop. It is apparent that if turbine stage 105 is allowed to run at an idle RPM as a normal operating speed, then negative pulsing can be achieved.

Figure 6B:
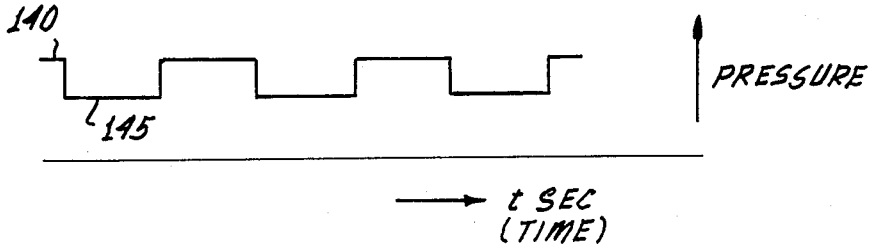
FIG. 6*b* is a graphical illustration of a negative pulsing mode of one of the turbine stages of FIG. 5.

FIG. 6*b* illustrates the operation of turbine stage 110 in which at a zero RPM for example, the pressure drop is as indicated at 140. As the RPM increases, the pressure drop decreases as at 145, producing the negative pulse as shown. Here again, it is possible to operate in a positive pulse mode by allowing the turbine stage 110 to run at an idle speed and braking the speed to produce a positive pulse.

Figure 6C:
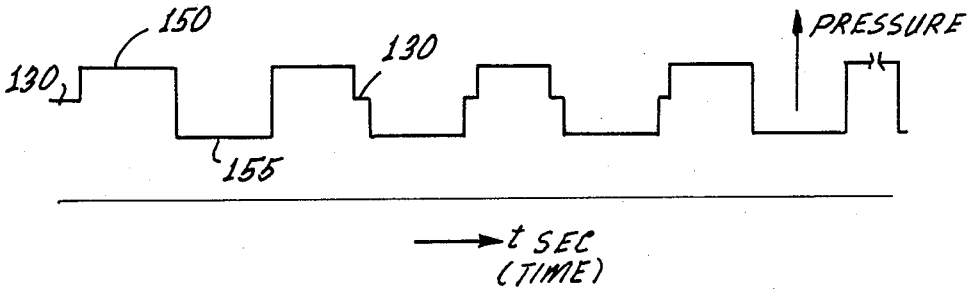
FIG. 6*c* is a graphical illustration of positive and negative pulsing modes.

FIG. 6*c* illustrates both positive and negative pulsing. Here the RPM of the turbine stage is at 130 resulting in a pressure drop between the minimum and maximum. If the speed of turbine stage 105 is increased, or the speed of turbine stage 110 is decreased, each relative to the null point 130, then a positive pulse 150 is formed. Coversely, if the speed of turbine stage 105 is decreased, or the speed of turbine stage 110 increased, each relative to the null point 130, then a negative pulse 155 is formed. In this way combinations of positive and negative pulses may be formed, if desired.

It will also be apparent that operation in the idle RPM mode is desired since it provides low power consumption, as already noted.

From the foregoing it will be seen that this invention is one well adapted to attain all of the ends and objects hereinabove set forth, together with other advantages which are obvious and which are inherent to the apparatus. It will be understood that certain features and subcombinations are of utility and may be employed without references to other features and subcombinations. This is contemplated by and is within the scope of the claims. As many possible embodiments may be made of the invention without departing from the scope thereof, it is to be understood that all matter herein set forth or shown in the figures of the accompanying drawing is to be interpreted as illustrative and not in a limiting sense.

What is claimed is:

1. A logging-while-drilling tool for use in an earth drilling apparatus comprising:

a drill string having a drill bit at the lower end thereof, said drill string receiving flow of drilling fluid which flows through said drill bit, a housing positioned in said drill string and above said drill bit such that drilling fluid which is circulated through the drill string will flow around the housing;

a shaft journaled in the housing;

means mounted on said shaft outside of said housing and including a rotating element and said means having a pressure response characteristic related to the rotational speed of said rotating element for generating pressure pulses in response to changes in the rotational speed of said rotating element while said drilling fluid continuously flows therethrough;

said rotating element being continuously and rotatingly driven solely by drilling fluid flowing through said drill string and having a predetermined pressure response characteristic in response to continuous flow therethrough; and means for changing the rotational speed of said rotating element in order to change the pressure response thereof while said drilling fluid flows therethrough and thereby to generate a pressure pulse which is transmitted through said drilling fluid.

2. A logging-while-drilling apparatus as set forth in claim 1 wherein said means mounted on said shaft includes a turbine stage having at least one stator and at least one rotor.

3. A logging-while-drilling apparatus as set forth in claim 1 wherein said means for changing said speed is a brake means.

4. A logging-while-drilling apparatus as set forth in claim 3 further including a generator driven by said shaft for providing electrical power for operating said brake means.

5. A logging-while-drilling apparatus as set forth in claim 3 wherein said brake means is a hydraulic brake assembly.

6. A logging-while-drilling apparatus as set forth in claim 5 wherein said hydraulic brake assembly includes a pump positioned within said housing and driven by said shaft;

said housing containing a fluid other than said drilling fluid;

said pump having an inlet and an outlet discharging said fluid other than said drilling fluid into said housing; and valve means controlling the discharge of said fluid other than said drilling fluid into said housing whereby the rotational speed of said pump may be changed to alter the rotational speed of said rotating element thereby to provide pulses in said drilling fluid.

7. A logging-while-drilling apparatus as set forth in claim 6 wherein said rotating element includes turbine means having at least a rotatable rotor connected to said shaft, and said apparatus further including electrical power means for controlling the operation of said valve means.

8. A logging-while-drilling apparatus as set forth in claim 7 wherein a change in the speed of said rotor rotation results in a pressure pulse of decreased or increased pressure.

* * * * *